United States Patent [19]

Blomgren

[11] 4,400,843

[45] Aug. 30, 1983

[54] ROTARY FLOOR CLEANER

[75] Inventor: Roland A. Blomgren, Glen Ellyn, Ill.

[73] Assignee: Service Master Industries, Inc., Downers Grove, Ill.

[21] Appl. No.: 310,116

[22] Filed: Oct. 9, 1981

[51] Int. Cl.[3] ..... A47L 11/162; A47L 11/03

[52] U.S. Cl. ..... 15/49 R; 15/50 R; 15/98; 51/177

[58] Field of Search ..... 15/49 R, 49 C, 50 R, 15/98, 385, 412; 51/177, 170, 170 T, 170 TL, 170 MT, 175

[56] References Cited

U.S. PATENT DOCUMENTS

| | | | |
|---|---|---|---|
| 1,209,720 | 12/1916 | Kirby . | |
| 1,594,685 | 8/1926 | Osius . | |
| 1,891,175 | 12/1932 | Petersen | 15/49 R X |
| 2,026,006 | 12/1935 | Wennerstrom | 15/49 R X |
| 2,136,268 | 10/1938 | Watts | 15/8 |
| 3,428,984 | 2/1969 | Collier | 15/49 R |

*Primary Examiner*—Edward L. Roberts

*Attorney, Agent, or Firm*—Allegretti, Newitt, Witcoff & McAndrews, Ltd.

[57] ABSTRACT

This invention provides a rotary floor cleaner having means for detachably securing the drive mechanism to the base of the unit, said means including wedge blocks against which the drive mechanism may be wedged and a rotatable cam for incrementally forcing the drive mechanism into wedging engagement between the wedge blocks and the cam.

8 Claims, 5 Drawing Figures

ROTARY FLOOR CLEANER

BACKGROUND OF THE INVENTION

The present invention relates generally to a rotary floor cleaner and, more particularly, to an improved means for securing the drive mechanism of a rotary floor cleaner to the base thereof.

A rotary floor cleaner is a type of cleaning apparatus typically used by professional rug and floor cleaning personnel. Recently, such rotary floor cleaners have become available, on a rental basis, through stores and other commercial facilities.

The rotary floor cleaner includes a base, or housing, and a rotatable cleaning element within the base. The cleaning element is often referred to as the cleaning rotor.

The cleaning rotor is powered by a drive mechanism attached to the base, usually immediately above the cleaning rotor. The drive mechanism itself includes an electric motor, a gear box interconnecting the motor and the cleaning rotor, and a protective housing.

One problem encountered with the rotary floor cleaner is handling. Such cleaners often weigh as much as 125 pounds and transportation, loading and unloading is difficult even for the professional cleaning team. The problem is much greater for the individual who rents a rotary cleaner, transports it home in the trunk of an automobile, and then must carry the cleaner up a flight of stairs.

A second problem concerns maintenance and repair. When the drive mechanism fails, the rotary floor cleaner cannot be quickly repaired. The drive mechanism, rigidly attached to the base, must be physically detached and replaced, and this procedure often requires a trained professional.

SUMMARY OF THE INVENTION

In a principal aspect, the present invention is an improved means for securing the drive mechanism of a rotary floor cleaner to the base thereof. The improved securing means permits the drive mechanism to be quickly and readily detached, or released, from the base, such that the rotary floor cleaner can be more easily handled and carried as two components. Further, a damaged drive mechanism can be quickly replaced without a professional, trained repairman.

The improved securing means includes one or more mounting flanges mounted on the housing, one or more wedge blocks attached to the base, and a cam attached to the base. The wedge blocks and the cam cooperatively act as the cam is rotated from an open to a closed position to wedge the drive mechanism and its mounting flange and hold them securely between the wedge blocks and the cam.

Thus, it is an object of the present invention to provide an improved rotary floor cleaner.

It is another object of the present invention to provide a rotary floor cleaner in which the drive mechanism, which accounts for approximately one half of the weight of the apparatus, may be easily and quickly detached by the operator for ease of transportation or for repair and replacement.

A further object of the present invention is to provide a quick-disconnect mechanism for a rotary floor cleaner which is inexpensive to manufacture and simple in construction.

It is yet another object of the present invention to provide a means for securely holding a detachable drive mechanism in a rotary floor cleaner that may be subject to rapid and voilent vibrations and shocks.

These and other objects, advantages, and features of the present invention will be set forth in the detailed description which follows.

BRIEF DESCRIPTION OF THE DRAWINGS

A preferred embodiment of the present invention will be described, in detail, with reference to the drawings wherein.

DESCRIPTION OF THE PREFERRED EMBODIMENT

Figure 1:
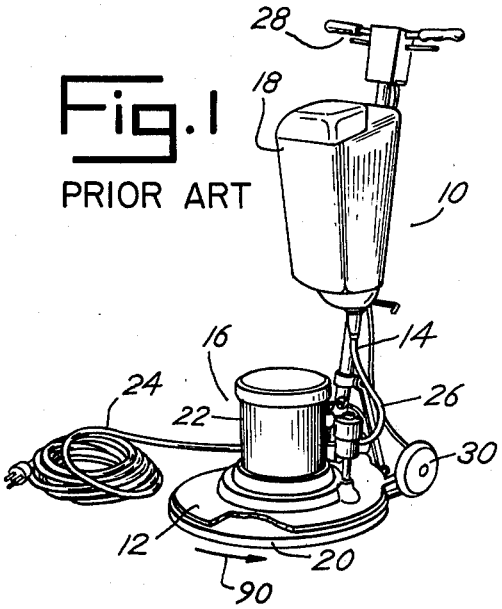
Fig. 1 PRIOR ART
FIG. 1 is a perspective view of a conventional rotary floor cleaner with a portion cut away to show the rotatable cleaning rotor.

As shown in FIG. 1, the invention relates to a machine 10 commonly known as a rotary floor cleaner having a base 12. Within the base 12 is a rotatable cleaning rotor 20, as shown in the cutaway portion of FIG. 1. A drive mechanism 16 mounted above the base 12 comprises an electric motor, a protective housing 22, and a gear box. Power is supplied to the electric motor by means of a conventional electric cord 24. Attached to the base 12 is an operating handle 14, on which there is mounted a solution tank 18. In operation, the electric motor drives the gear box which, in turn, operates to rotate the cleaning rotor 20 at high speeds. Cleaning solution from the solution tank 18 is fed through tube 26 to the cleaning rotor 20, whereupon it is applied to the surface to be cleaned. Typically, the flow of the solution is controlled by the operator through controls 28. Such machines typically are provided with wheels 30 to facilitate maneuverability.

Figure 2:
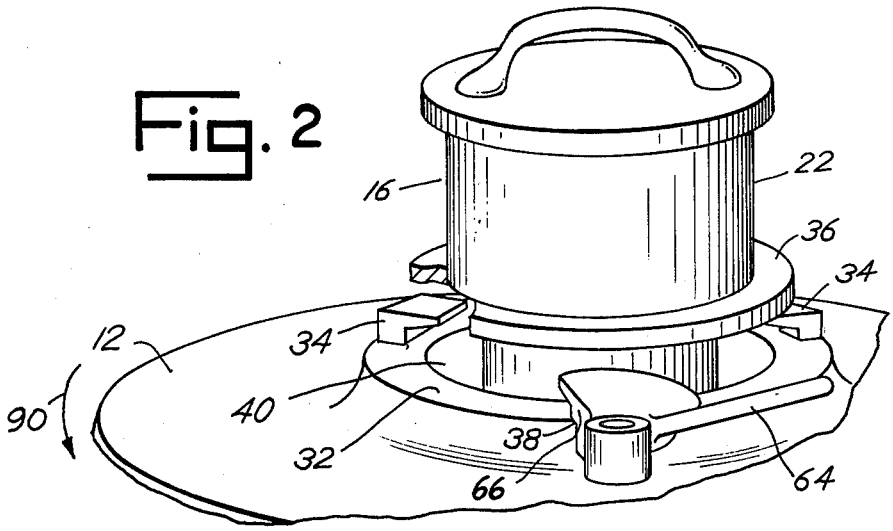
FIG. 2 is perspective exploded view of a drive mechanism and a base of the preferred embodiment of the invention in detached relationship with a portion of the mounting flange cut away, showing in more detail the means by which the drive mechanism may be detachably mounted to the base.

The present invention provides an improved means by which the drive mechanism 16 may be quickly and easily separated from the base 12, when desired, while being securely mounted thereupon at other times. As best shown in FIG. 2, base 12 includes a motor mount 32 on which there are mounted at least one and preferably two wedge blocks 34. These are secured by any conventional means, such as screws or bolts, or the wedge blocks may be integrally formed with the base. Also, mounted on base 12 is a cam 38, which is rotatably mounted around a first axis substantially normal to the plane of the motor mount 32. Motor mount 32 of base 12 defines an opening 40. When in the operating position, the gear box, which is not shown but which is enclosed by the motor housing 22, is in driving engagement with the cleaning rotor 20 through the opening 40. Mounted on the exterior side surface of housing 22 is a mounting flange 36 is proximity to the lower end of the housing 22. Mounting flange 36 is adapted to rest upon motor mount 32.

Figure 3:
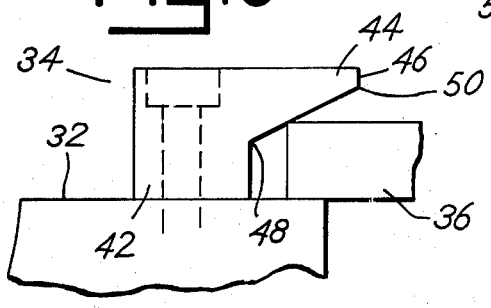
FIG. 3 is an enlarged side view of a wedge block mounted on a base with a portion of the mounting flange being shown.

As shown in FIG. 3, wedge block 34 comprises an upright stanchion mounted on the motor mount 32 of base 12. Stanchion 42 includes a projecting arm 44, which projects in the direction of opening 40. The arm 44 includes a front surface 50, which, as is best shown in FIG. 3, is inclined horizontally with respect to the plane of the opening 40. This is accomplished by locating the outer edge 46 of front surface 50 such that it is in closer proximity to the opening 40 and at a higher elevation from the base 12 than the inner edge 48 of front surface 50.

Figure 4:
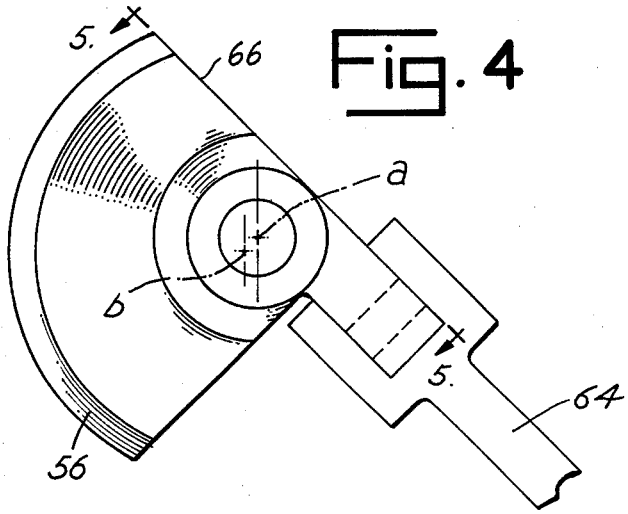
FIG. 4 is a bottom plan view of the cam of the preferred embodiment of the present invention.
Figure 5:
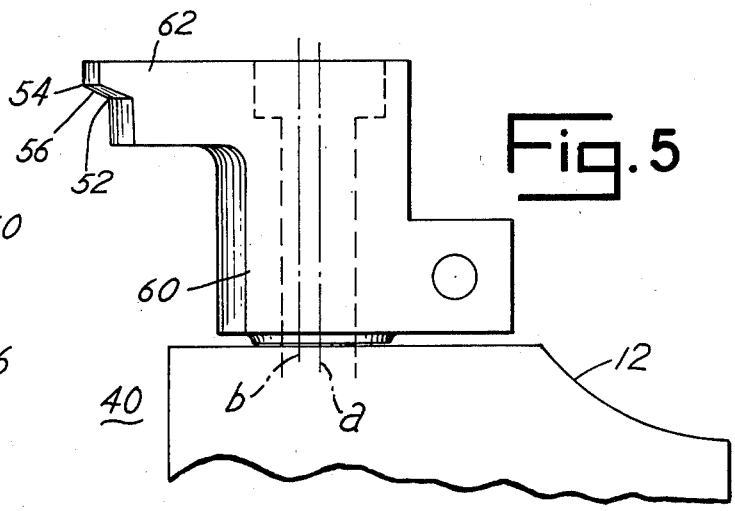
FIG. 5 is an elevational view of the cam as viewed along line 5—5 in FIG. 4 with a portion of the base being shown.

With reference to FIGS. 4 and 5, cam 38 is rotatably mounted on motor mount 32 of base 12. Cam 38 rotates about a first axis a, which is best shown in FIG. 5. Cam 38 comprises an upright pillar 60 with a projecting limb 62. Formed in the limb 62 is an arcuate first edge 52, an arcuate first edge 52, an arcuate second edge 54 in closer proximity to the opening 40 relative to the first edge 52, and a shoulder surface 56 connecting the first edge 52 and the second edge 54. Second edge 54 is also at a higher elevation from the base 12 relative to the first edge 52, whereupon shoulder surface 56 is inclined horizontally with respect to the plane of the opening 40 in a manner similar to the front surface 50 of the wedge block 34 being inclined. First edge 52 and second edge 54, and consequently, shoulder surface 56, are radially disposed about a second axis b, which is offset from the first axis a, as best shown in FIG. 5. As a result of the offset of second axis b, the shoulder surface 56 moves relative to the opening 40 when cam 38 is rotated about first axis a.

In the embodiments depicted in FIGS. 2 and 4, the cam 38 includes grip 64 which is useful for rotating the cam 38 by hand. In the embodiment shown in FIG. 4, the grip 64 is formed as a separate piece from the case 38 and is attached thereto by any suitable means allowing it to swing freely. Cam 38 also includes a substantially flat face 66 formed in a plane perpendicular to the plane containing first axis a and second axis b. Face 66 is relatively more distant from second axis b than from first axis a.

To assemble the machine, drive mechanism 16 is lowered from above so that the mounting flange 36 rests upon motor mount 32. Such movement is facilitated when cam 38 is rotated such that face 66 is adjacent to opening 40. Drive mechanism 16 is slid such that mounting flange 36 contacts front surface 50 of each wedge block 34. In this position, the gear box comes into driving engagement with cleaning rotor 20. Cam 38 is rotated about axis a so that shoulder surface 56 of cam 38 also comes into contact with mounting flange 36. As cam 38 is rotated, and as shoulder surface 56 becomes relatively closer to opening 40 and mounting flange 36, the mounting flange 36 is incrementally forced into wedging engagement between wedge blocks 34 and cam 38, thereby securely attaching drive mechanism 16 to the base 12.

In the machine shown in FIG. 2, the cleaning rotor 20 turns counterclockwise, when viewed from the top, as indicated by arrow 90. In the embodiment of the invention described herein, the resulting reaction forces on the housing 22 and mounting flange 36, which tend to urge the same in a relative clockwise direction, cooperate with the cam 38, which, like the cleaning rotor 20, also rotates in a relative counterclockwise direction when moving from the unlocked position to the locked position, by urging the mounting flange 36 into the shoulder surface 56 such that the assembly is self-tightening. Of course, the direction of rotation of the cleaning rotor 20, and the cam 38, can be reversed with the same effect.

In the preferred embodiment shown, opening 40 is circular in shape and there are two wedge blocks 34 disposed about the opening 40. Also, the wedge blocks 34 are approximately radially equidistant from each other and from the cam 38. The use of two wedge blocks, each approximately one and one half inches wide, is preferred.

The facilitate mounting of the drive mechanism 16 on the base 12 when the cam 38 is in the fully unlocked position, wedge blocks 34 preferably are spaced at least at an angle of 100° from cam 38. In this embodiment, there is an unobstructed opening of at least 200° into which mounting flange 36 may be set and slid towards wedge blocks 34.

The present invention facilitates not only disassembly of a rotary floor cleaner for movement to and from a job site, but also for purposes of removal and replacement of drive mechanism 16 for routine maintenance while allowing continued operation of the remainder of the device.

A single preferred embodiment of the present invention has been disclosed and described in the drawings herein. It is to be understood, however, that various changes and modifications can be made without departing from the true scope and spirit of the present invention as set forth and defined in the following claims.

What is claimed is:

1. In an improved rotary floor cleaner having, in combination, a rotatable cleaning rotor; a base circumferentially surrounding said cleaning rotor and including an opening adjacent to said cleaning rotor; and a drive mechanism disposed above said opening in said base, said drive mechanism including an electric motor and a housing, said motor in driving engagement with said cleaning rotor; wherein the improvement comprises:

(a) at least one mounting flange on the exterior side surface of said housing in proximity to the lower end thereof;

(b) at least one wedge block on said base adjacent to said opening, said wedge block having an inner edge, an outer edge in closer proximity to said opening relative to said inner edge and at a higher elevation from said base relative to said inner edge, and a front surface connecting said outer edge and said inner edge such that said front surface is inclined horizontally with respect to the plane of said opening, said wedge block being located so that said front surface faces said opening whereby said mounting flange is forced against said front surface when said drive mechanism is mounted on said base and forced in the direction of said wedge block; and (c) a cam rotatably mounted around a first axis on said base adjacent to said opening, said cam rotatable between an unlocked position and a locked position, said cam having an arcuate first edge, an arcuate second edge in closer proximity to said opening relative to said first edge and at a higher elevation from said base relative to said first edge, and a shoulder surface connecting said first edge and said second edge such that said shoulder surface is inclined horizontally with respect to the plane of said opening, said first and second edges being radially disposed around a second axis, said second axis being offset from said first axis, whereby said first and second edges, and said shoulder surface, move relatively closer to said opening when said cam is rotated about said first axis, and whereby said shoulder surface is increasingly forced against said mounting flange when said drive mechanism is mounted above said opening and said cam is rotated about said first axis, thereby wedging said mounting flange between said front surface on said wedge block and said shoulder on said cam.

2. An apparatus as in claim 1, wherein said mounting flange substantially surrounds said housing.

3. An apparatus as in claim 1, wherein said cam includes a grip for rotating said cam.

4. An apparatus as in claim 1, wherein said opening is circular, wherein there are at least two wedge blocks, and wherein the radial distance between said cam and the nearest wedge block is at least 100 degrees.

5. An apparatus as in claim 4, wherein there are two wedge blocks and wherein the radial distance between each of the two wedge blocks and the cam is 120 degrees.

6. An apparatus as in claim 4, wherein said cam includes a substantially flat face formed in a plane perpendicular to a plane containing said first axis and said second axis, said face being relatively more distant from said second axis than from said first axis, whereby said face is adjacent to said opening when said cam is in the fully unlocked position.

7. An apparatus as in claim 1, wherein the direction of the rotation of said rotatable cleaning rotor is the same as the direction of rotation of said cam when said cam is moving from an unlocked to a locked position.

8. In an improved rotary floor cleaner having, in combination, a rotatable cleaning rotor; a base circumferentially surrounding said cleaning rotor and including a circular opening adjacent to said cleaning rotor; and a drive mechanism disposed above said opening in said base, said drive mechanism including an electric motor, a gear box in driving engagement with said motor and said cleaning rotor, and a housing surrounding said motor and said gear box; wherein the improvement comprises:

(a) a mounting flange substantially surrounding the exterior side surface of said housing in proximity to the lower end thereof;

(b) two wedge blocks on said base adjacent to said opening and at a radial distance of 120 degrees from each other, each of said wedge blocks having an inner edge, an outer edge in closer proximity to said opening relative to said inner edge and at a higher elevation from said base relative to said inner edge, and a front surface connecting said outer edge and said inner edge such that said front surface is inclined horizontally with respect to the plane of said opening, said wedge blocks being located so that said front surfaces face said opening whereby said mounting flange is forced against said front surface when said drive mechanism is mounted on said base and forced in the direction of said wedge block; and (c) a cam rotatably mounted around a first axis on said base adjacent to said opening, said cam rotatable between an unlocked position and a locked position, said cam having an arcuate first edge, an arcuate second edge in closer proximity to said opening relative to said first edge and at a higher elevation from said base relative to said first edge, and a shoulder surface connecting said first edge and said second edge such that said shoulder surface is inclined horizontally with respect to the plane of said opening, said first and second edges being radially disposed around a second axis, said second axis being offset from said first axis, whereby said first and second edges, and said shoulder surface, move relatively closer to said opening when said cam is rotated about said first axis, and whereby said shoulder surface is increasingly forced against said mounting flange when said drive mechanism is mounted above said mounting flange between said front surface on said wedge block and said shoulder surface on said cam, said cam also having a substantially flat face formed in a plane perpendicular to a plane containing said first axis and said second axis, said face being relatively more distant from said second axis than from said first axis, whereby said face is adjacent to said opening when said cam is in the fully unlocked position.

* * * * *